United States Patent [19]

Haber et al.

[11] 4,096,974

[45] Jun. 27, 1978

[54] COVER ASSEMBLY FOR SPRAY CANS

[76] Inventors: Terry M. Haber, 3050 S. Bristol #8C, Santa Ana, Calif. 92707; James G. P. Dehlsen, 1740 Plaza del Norte, Balboa, Calif. 92661

[21] Appl. No.: 776,583

[22] Filed: Mar. 11, 1977

[51] Int. Cl.[2] ..... B65D 83/14

[52] U.S. Cl. ..... 222/402.13; 222/530; 222/538

[58] Field of Search ..... 222/530, 538, 527, 529, 222/402.11, 402.13, 402.17, 478, 481, 320–321, 182; 239/443, 446

[56] References Cited

U.S. PATENT DOCUMENTS

| | | | |
|---|---|---|---|
| 2,829,801 | 4/1958 | Ayres | 222/402.13 X |
| 3,180,536 | 4/1965 | Meshberg | 222/402.17 X |
| 3,358,890 | 12/1967 | Dalfo | 222/538 X |

FOREIGN PATENT DOCUMENTS

| | | | |
|---|---|---|---|
| 701,879 | 1/1941 | Germany | 222/530 |
| 1,144,385 | 3/1969 | United Kingdom | 222/527 |

*Primary Examiner*—Robert B. Reeves
*Assistant Examiner*—Charles A. Marmor
*Attorney, Agent, or Firm*—Ralph B. Pastoriza

[57] ABSTRACT

A rotatable sleeve is provided over the normal discharge nozzle on a spray can, the sleeve itself having a discharge port in its side wall positionable in registration with the discharge nozzle when rotated to a first position. A flexible hose connects to this discharge port which serves to guide the spray from the nozzle to enable accurate directing of the fluid within the can. A cup shaped cover is positioned over the sleeve and locked against rotation to the spray can. The cover has a side wall opening in alignment with the discharge nozzle through which the flexible hose extends. The arrangement is such that the sleeve can be rotated relative to the cover and can to thereby cause the flexible hose to be withdrawn from the side wall opening in the cover and wrapped around the sleeve in the annular space between the exterior of the sleeve and the interior of the cover to thereby store the flexible hose when not in use.

7 Claims, 5 Drawing Figures

COVER ASSEMBLY FOR SPRAY CANS

This invention relates generally to aerosol type spray cans having upper valves which are operable by depressing a button to discharge a spray, and more particularly to an improved cover assembly for such spray cans.

BACKGROUND OF THE INVENTION

Aerosol type spray cans are in wide use and generally incorporate a gas under pressure for ejecting the fluid contents of the can in the form of a sprray through an upper discharge nozzle. Lacquer and paints may be applied on surfaces from such spray cans. In addition, lubricants such as oil and the like and/or cleaning fluids can be ejected from such cans and these latter substances find wide use in the automotive industry in lubricating and/or cleaning portions of automobile engines.

It is common practice in the manufacture of conventional spray cans particularly those containing a lubricating fluid or a cleaning fluid to provide a small flexible hose normally held to the exterior of the can by a rubber band. This hose is dimensioned to be manually inserted in the discharge nozzle forming part of the upper valve assembly of the can so that the fluid within the can will be guided and confined by this flexible hose. The arrangement is such that hard-to-reach places requiring lubrication or cleaning can be appropriately treated, the flexible hose serving to permit accurate directing of the fluid.

Because the flexible hose is simply held to the can by a rubber band when the can is purchased, it can become separated and lost. In addition, however, once the hose has been used by insertion in the nozzle, it is not uncommon practice for a user to disconnect the hose so that the normal nozzle spray pattern can be utilized for larger area surfaces to be treated. In this latter event, the user will often simply place the flexible hose on a workbench or perhaps on the fender portion of a car and again there is the possibility of it becoming lost.

While it is possible, of course, to provide a flexible hose permanently connected to the discharge nozzle of the can, such feature would render the spray can useless for conventional type spray operations wherein a very wide spray pattern might be desired.

BRIEF DESCRIPTION OF THE PRESENT INVENTION

With the foregoing in mind, the present invention contemplates an improved modified cover assembly which can be used with conventional spray cans requiring only slight modifications in such a manner that a flexible hose is always available for use with the spray nozzle and yet may be stored within the cover assembly itself when not in use all to the end that risks of losing the flexible hose are eliminated.

More particularly, in accord with the present invention, a rotatable sleeve is designed to be received over the normal discharge nozzle on a spray can. This sleeve has a discharge port in its side wall positionable to register with the discharge nozzle of the can when rotated to a first position relative to the can.

A flexible hose, in turn, is permanently connected to the discharge port in the sleeve and a cup shaped cover similar to the normal covers provided on such spray cans is arranged to be positioned over the sleeve and locked against rotation to the spray can. This cover is never removed from the spray can but is provided with a side wall opening in alignment with the normal discharge nozzle, the flexible hose extending through this side wall opening. The arrangement is such that fluid from the can may be discharged through the flexible hose for accurate directing of the fluid. In addition, the sleeve can be easily rotated to a second position to cause the flexible hose to be withdrawn through the side wall opening of the cover and wrapped about the sleeve in the annular space between the exterior of the sleeve and the interior of the cover, to thereby store the flexible hose when not in use. A further discharge opening can be provided in the sleeve circumferentially spaced from the discharge port to which the flexible hose connects, this second opening becoming aligned with the side wall opening in the cover and the discharge nozzle of the can when the sleeve is rotated to the referred to second position so that the normal spray pattern can be passed through the side wall opening in the cover and the spray can used in a conventional manner.

BRIEF DESCRIPTION OF THE DRAWINGS

A better understanding of this invention will be had by now referring to the accompanying drawings in which.

DETAILED DESCRIPTION OF THE INVENTION

Figure 1:
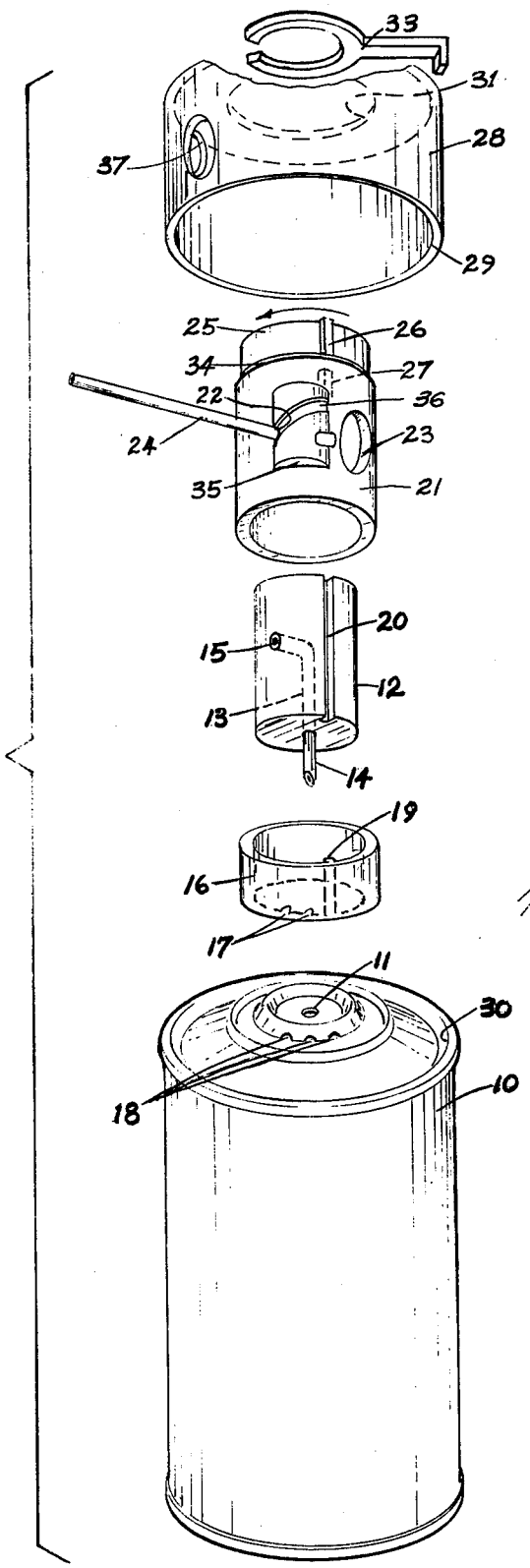
FIG. 1 is a perspective view of a conventional spray can illustrating in exploded sequence the basic components making up the cover assembly of this invention.

Referring to the lower portion of FIG. 1 there is shown a conventional aerosol type spray can 10 including an upper valve 11 for receiving a discharge tube. The valve itself is normally responsive to downward movement of the discharge tube to open and permit fluid contents in the spray can to pass out under pressure.

As shown in the central portion of FIG. 1, there is provided a cylindrical member 12 supporting in coaxial relationship an appropriate discharge tube 13, the lower end 14 of which extends from the lower end of the cylindrical member as shown. The upper end of the discharge tube 13 communicates with a lateral outlet nozzle 15 in the side wall of the cylindrical member 12.

Shown immediately below the cylindrical member 12 is a collar 16 arranged to be secured to the upper end of the can 10 and towards this end, the collar 16 may include small inward projections 17 at its lower end arranged to register with small notches 18, constituting a normal part of the construction of the upper portion of the can 10 thereby locking the collar 16 to the can. The collar 16 is arranged to telescopically receive the lower end of the cylindrical member such that the discharge tube 14 will be received in the valve 11 in such a manner that telescoping downward movement of the cylindrical member 12 within the collar 16 will actuate the valve 11 and permit fluid under pressure to pass through the lower end 14 of the discharge tube 13 and thence to the lateral nozzle 15.

In order that the lateral nozzle 15 of the cylindrical member 12 will be oriented in a consistent direction relative to the can 10, the cylindrical member 12 is keyed to the collar 16 as by an inwardly projecting key 19 slidably received within an elongated groove 20 in the exterior of the cylindrical member 12. This keying means prevents rotation of the cylindrical member with respect to the collar 16 during downward telescoping movement of the cylindrical member in the collar 16.

Referring now to the upper portion of FIG. 1, there is shown immediately above the cylindrical member 12 a rotatable sleeve 21 having a discharge port 22 in a first portion of its side wall and a larger diameter discharge opening 23 in a second portion of its side wall circumferentially spaced from the discharge port 22 and at the same axial level from the bottom of the sleeve as the discharge port. A flexible hose 24 connects to the discharge port 22 and extends laterally from the sleeve as shown.

A counterpart to the normal actuating button for the spray can is shown at 25 receivable in the upper end of the sleeve 21 for engaging the upper end of the cylindrical member 12 when the components are assembled. Button 25 and sleeve 21 include cooperating keying means in the form of an outwardly extending ridge 26 receivable in a guide slot 27 in these components respectively. This keying means permits downward movement of the button 25 in the sleeve 21 and yet locks the button 25 to the sleeve so that rotation of the button 25 will cause rotation of the sleeve 21.

Referring now to the upper portion of FIG. 1, there is shown a cup shaped cover 28 receivable over the sleeve to surround the same in spaced coaxial relationship, the lower periphery of this cover as indicated at 29 being arranged to seat on the upper periphery of the spray can 10 in a forced engagement with the annular rim of the spray can indicated at 30 so that the cup shaped cover 28 is permanently part of the spray can 10 and will not rotate with respect thereto. As indicated by the phantom showing, the upper end of the spray can cover 28 has a reduced diameter bore opening 31 through which the upper portion of the button 25 extends when the various components are assembled. In addition, the cover 28 includes a side wall opening 32 circumferentially positioned to be in radial alignment with the lateral outlet nozzle 15 of the cylindrical member 12 when the components are assembled.

The foregoing arrangement is such that when the sleeve 21 is rotated to a first position, the discharge port 22 and flexible hose 24 at its point of connection to the discharge port will register with the lateral discharge nozzle 15 of the cylindrical member 12 when the button is depressed. Rotation of the sleeve by rotation of the button 25 relative to the cylindrical member 12 and cup shaped cover 28 to a second position, however, will position the discharge opening 23 in the sleeve 21 in alignment with the discharge nozzle 15 of the cylindrical member 12 so that the flexible hose 24 is effectively no longer in communication with the discharge nozzle and normal spray can be ejected from the can through the opening 32 in the cover 28.

All of the foregoing will become clearer with respect to FIGS. 2 through 5 which will be described shortly.

The basic components of FIG. 1 are completed by the provision of a snap lock 33 shown above the cup shaped cover 28. This snap lock may take the form of a metal stamping defining a yoke portion arranged to be received within an annular groove 34 on the button 25 to prevent downward movement of the button 25 relative to the cup shaped cover 28. This snap lock arrangement would be provided to prevent inadvertent operation of the spray can by depression of the button during shipping to a retail outlet. In conventional spray cans, inadvertent operation is prevented by a cup shaped cover which is removed to operate the spray can. Since the cover 28 of the assembly of the present invention is a permanent part of the can and is not removed, it is desirable to provide a removable snap lock such as indicated at 33. It will be understood, of course, that when the can is to be used, the snap lock 33 is simply removed and thrown away.

Figure 2:
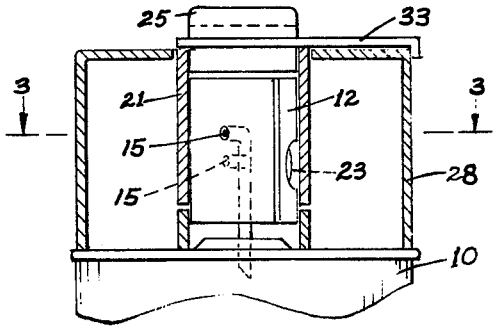
FIG. 2 is a fragmentary view partly in cross section of the upper portion of the can with the cover assembly components in assembled relationship.

Referring now to FIG. 2, the heretofore described motion of the button 25 to effect alignment of the discharge nozzle 15 in the cylindrical member 12 with the discharge port 22 in the sleeve 21 to cause fluid in the can to pass through the flexible hose 24 is indicated by the dashed lines. Thus, when the button 25 is depressed, it will lower the discharge nozzle 15 along with the discharge tube 14 described in FIG. 1 to thereby actuate the valve assembly 11 at the top of the can 10. When in this lower position as indicated by the dashed lines, this discharge nozzle will be in alignment with the discharge port 22 of the sleeve 21 as also described with respect to FIG. 1. The valve for the can 10 is spring loaded so that release of pressure on the button 25 will permit it to move upwardly to its solid line position and close the valve.

Because of the keying of the button 25 to the sleeve 21, the sleeve 21 can be rotated by rotating the button 25 relative to the cup shaped cover 28 and cylindrical member 12.

Figure 3:
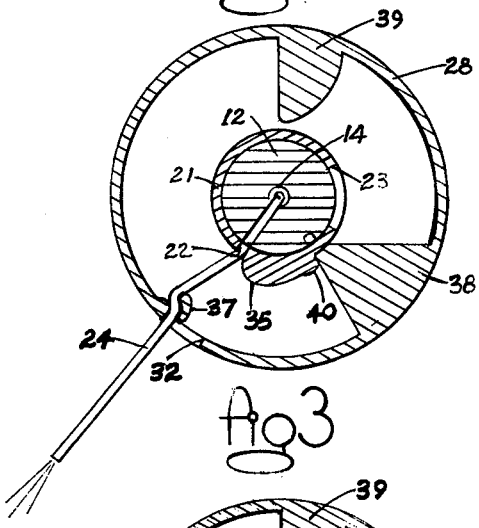
FIG. 3 is a cross section looking in the axial direction of the can taken in the direction of the arrows 3—3 of FIG. 2 and illustrating the assembly in a first position.

Referring to the cross section of FIG. 3, the alignment of the discharge port 22 and flexible hose 24 with the discharge tube 14 in the cylindrical member 12 will be evident, the flexible hose 24 passing out of the side wall opening 32 in the cover member 28. In this first position of the sleeve 21, the button 25 as described in FIG. 2 can be depressed to actuate the spray can and appropriate fluid in the can will be directed through the flexible hose 24 and out of its end. Thus, hard-to-get-at areas may be treated by using the flexible hose 24 to guide and direct the spray.

It will be noted in the cross section of FIG. 3 that there is provided a lobe 35 on the sleeve 21 adjacent to the discharge port 22 where the flexible hose 24 connects. Referring once again to the sleeve 21 as illustrated in FIG. 1, it will be noted that the lobe 35 is provided with a spiral groove 36. The arrangement is such that when the button 25 and sleeve 21 are rotated in a clockwise direction as viewed in FIG. 3, the flexible hose 24 will be withdrawn through the side wall opening 32 and caused to wrap around the sleeve 21, this wrapping action being guided by the groove and lobe structure described so that the flexible hose will lie in the annular space between the exterior of the sleeve 21 and the interior of the cup shaped cover 28.

Figure 4:
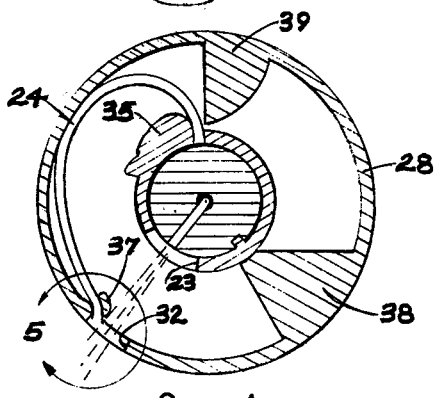
FIG. 4 is a view similar to FIG. 3 but illustrating the components when rotated to a second position; and, FIG. 5 is a greatly enlarged fragmentary view of that portion of FIG. 4 enclosed within the circular arrow 5.

The foregoing stored or wrapped around position of the flexible hose 24 is depicted in FIG. 4 wherein the sleeve 21 has been rotated from the first position illustrated in FIG. 3 to a second position illustrated in FIG. 4. In this second position, it will be further noted that the additional opening 23 in the sleeve 21 is now in registration with the discharge nozzle of the cylindrical member 12 and since the cylindrical member 12 and cup shaped cover 28 are both stationary with respect to the sleeve 21, normal spray can be ejected from the discharge nozzle through the discharge opening 23 of the sleeve and the side wall opening 32 in the cover. It will be appreciated that the flexible hose is stored in the area between the sleeve and cover when not in use and yet the spray can can be used in a conventional manner.

If it is desired to again take advantage of the guiding and directing properties of the flexible hose 24, it is only necessary for a user to rotate the button and thence the sleeve 21 in a counterclockwise direction as viewed in FIG. 4 to return the sleeve to its position illustrated in FIG. 3; that is, the first position described. This action causes the flexible hose 24 at its connection point to the discharge port 22 to again be in registration or communication with the discharge tube 14 in the cylindrical member 12 so that when the button is now actuated, spray will again be guided and directed by the flexible tube 24.

The flexible tube itself may have some "memory" and tend to remain in its curved or bent position when stored for a long time as depicted by the position of FIG. 4. In order that the flexible hose will extend through the cover opening 32 in a fairly straight line direction when it is to be used, there is provided a curved guide channel 37 adjacent to the side wall opening 32 of the cover 28. This curved guide channel is depicted by the same numeral 37 in the showing of FIG. 1 and also in the showing of FIG. 4.

Figure 5:
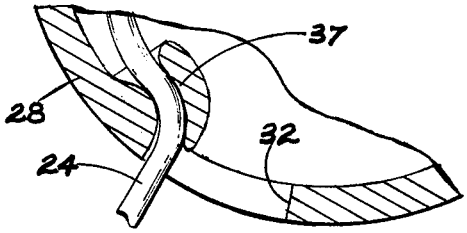

FIG. 5 illustrates the curved guide channel 37 in greater detail, wherein it will be evident that it exerts a reverse bend on the flexible hose 24 when it is urged out through the opening 32 by rotation of the sleeve 21 from its position illustrated in FIG. 4 back to its position illustrated in FIG. 3. This reverse bending action will substantially cancel any curve in the flexible hose 24 resulting from its being stored for a fairly long time.

In order to facilitate the action of rotating a sleeve between its first and second positions described in FIGS. 3 and 4, there are provided stop means extending radially inwardly from the outside of the cover 28 as indicated at 38 and 39 in FIG. 3. Thus, this stop means includes a small stop projection 40 on or adjacent to the lobe 35 of the sleeve for engagement by the stop 38 when the sleeve 21 is rotated from the position illustrated in FIG. 4 to the position illustrated in FIG. 3. The opposite portion of the lobe 35 in turn serves to engage the stop 39 when the sleeve is rotated in an opposite direction; that is, from the position illustrated in FIG. 3 to the position illustrated in FIG. 4. These stop means thus assure appropriate registration of the discharge port 22 and flexible hose 24 with the discharge nozzle when the sleeve is in its first position illustrated in FIG. 3, and, proper registration of the discharge opening 23 of the sleeve with the discharge nozzle when the sleeve is in its second rotated position illustrated in FIG. 4.

From all of the foregoing, it will thus be evident that the present invention has provided an improved cover assembly for spray cans wherein the desirable feature of providing a flexible hose for use with the spray can is realized without risk of the hose becoming separated or lost from the can. Moreover, the cooperation of the various components making up the cover assembly as described makes it very easy for a user to alternately utilize the flexible hose and the normal spray pattern provided from the spray nozzle on the can.

We claim:

1. A cover assembly for spray cans including, in combination:

(a) a rotatable sleeve receivable over the normal discharge valve and nozzle on said spray can and having a discharge port in its side wall positionable to register with said discharge nozzle when rotated to a first position;

(b) a flexible hose connected to said discharge port;

(c) a cup shaped cover positioned over said sleeve and locked against rotation to said spray can, said cover having a side wall opening in alignment with said discharge nozzle through which said flexible hose extends; and (d) means passing through the top of the cup shaped cover to effect engagement and opening of said discharge valve whereby fluid from said can is discharged through said flexible hose for accurate directing of the fluid and whereby said sleeve can be rotated to a second position to cause said flexible hose to be withdrawn through said side wall opening and wrapped around said sleeve in the annular space between the exterior of said sleeve and the interior of said cover to thereby store said flexible hose when not in use.

2. An assembly according to claim 1, in which said sleeve includes a discharge opening circumferentially spaced from said discharge port and flexible hose connection, said discharge opening being aligned with said discharge nozzle when said sleeve is rotated to said second position so that a normal spray pattern can be provided through said discharge opening and side wall opening in said cover.

3. A cover assembly for spray cans wherein the spray can includes an upper valve for receiving a discharge tube and is responsive to downward movement of said tube to open, said assembly including:

(a) a cylindrical member supporting a coaxial discharge tube, the lower end of said tube extending from the lower end of said cylindrical member and the upper end communicating with a lateral outlet nozzle in the side wall of said cylindrical member;

(b) a collar secured to the upper end of said can telescopically receiving the lower end of said cylindrical member, said collar and member having cooperating keying means to prevent rotation of said member in said collar during telescoping movement;

(c) a rotatable sleeve surrounding the upper portion of said cylindrical member, said sleeve having a discharge port in a first portion of its side wall and a larger diameter discharge opening in a second portion of its side wall circumferentially spaced from said discharge port and at the same axial level from the bottom of said sleeve as said discharge port;

(d) a flexible hose connected to said discharge port laterally extending from said sleeve;

(e) an actuating button receivable in the upper end of said sleeve for engaging the upper end of said cylindrical member, said button and sleeve having cooperating keying means to prevent rotation of said button in said sleeve;

(f) a cup shaped cover receivable over said sleeve to surround the same in spaced coaxial relationship, the lower periphery of said cover being seating on and locked to the top periphery of said spray can and the upper end of said cover having a reduced diameter bore opening through which the upper portion of said button extends, said cover additionally including a side wall opening circumferentially positioned to be in radial alignment with said lateral outlet nozzle such that when said sleeve is rotated to a first position relative to said cover and cylindrical member, said discharge port in said sleeve is in a position for registration with said discharge nozzle when said button is depressed, said flexible hose extending through said side wall opening so that spray can pass therethrough and be accurately directed, rotation of said sleeve to a second position, causing said flexible hose to be withdrawn from said side wall opening and wrapped around said sleeve within the annular space defined between the exterior of said sleeve and the interior of said cover, said sleeve when in said second position having its discharge opening in a position for registration with said discharge nozzle when said button is depressed so that spray can pass from said nozzle through said discharge opening and side wall opening in said cover to provide a normal spray pattern.

4. An assembly according to claim 3, in which said cover and sleeve include cooperating circumferentially spaced first and second stop means for indexing the rotative position of said sleeve relative to said cover and cylindrical member to said first and second positions respectively.

5. An assembly according to claim 3, in which the exterior of said sleeve is provided with a lobe adjacent to said discharge port, said lobe having an exterior channel following a spiral path for said flexible hose when said hose wraps around said sleeve upon rotation of said sleeve from said first to said second position.

6. An assembly according to claim 3, in which said cover includes a curved guide channel at its side wall opening through which said flexible hose passes when said sleeve is rotated from its second position back to its first position to exert a reverse bend on said hose from its normally bent position when wrapped around said sleeve so that said flexible hose will extend in a substantially straight line direction from said side opening in said cover.

7. An assembly according to claim 3, including a snap lock receivable in an annular groove in said button exterior at said bore opening for locking said button against downward movement relative to said cover, said snap lock being removable to permit depressing of said button to operate said spray can.

* * * * *